US006450617B1

(12) United States Patent
Kitani et al.

(10) Patent No.: US 6,450,617 B1
(45) Date of Patent: Sep. 17, 2002

(54) INK JET PRINT HEAD AND INK JET PRINTING APPARATUS USING THE SAME

(75) Inventors: Masashi Kitani; Teruo Ozaki, both of Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/708,476

(22) Filed: Nov. 9, 2000

(30) Foreign Application Priority Data

Nov. 11, 1999 (JP) ..... 11-321372

(51) Int. Cl.[7] ..... B41J 2/05
(52) U.S. Cl. ..... 347/50
(58) Field of Search ..... 347/47, 48, 50, 347/64, 65

(56) References Cited

U.S. PATENT DOCUMENTS

| | | | | |
|---|---|---|---|---|
| 4,635,073 A | | 1/1987 | Hanson | 347/50 |
| 4,827,294 A | | 5/1989 | Hanson | 347/50 |
| 4,862,197 A | | 8/1989 | Stoffel | 347/59 |
| 4,922,269 A | | 5/1990 | Ikeda et al. | 347/50 |
| 5,576,748 A | | 11/1996 | Tamura | 347/58 |
| 6,000,777 A | | 12/1999 | Nozawa et al. | 347/20 |
| 6,062,678 A | * | 5/2000 | Ishinaga et al. | 347/62 |
| 6,123,410 A | * | 9/2000 | Beerling et al. | 347/42 |

FOREIGN PATENT DOCUMENTS

| | | |
|---|---|---|
| CA | 2085568 | 6/1993 |
| EP | 0441503 | 8/1991 |
| EP | 0916498 | 5/1999 |
| JP | 05-169662 | 7/1993 |

* cited by examiner

*Primary Examiner*—Anh T. N. Vo
(74) *Attorney, Agent, or Firm*—Fitzpatrick, Cella, Harper & Scinto

(57) ABSTRACT

The ink jet print head provides a good electrical connection with the silicon substrate. A silicon substrate of the ink jet print head the electrodes for electrical connection have a layer construction such that, under a part of the metal bumps, wires drawn from the cavitation resistant film and a metal layer not corroded by the ink are formed overlapping each other. The ink jet printing apparatus uses the ink jet print head constructed as described above.

10 Claims, 6 Drawing Sheets

INK JET PRINT HEAD AND INK JET PRINTING APPARATUS USING THE SAME

This application is based on Japanese Patent Application No. 11-321372 (1999) filed Nov. 11, 1999, the content of which is incorporated hereinto by reference.

BACKGROUND OF THE INVENTION

1. Field of the Invention

The present invention relates to an ink jet print head that prints on a print medium by ejecting from nozzles a printing liquid (hereinafter referred to as an ink) in the form of flying droplets onto the print medium to make them adhere to the print medium, and an ink jet printing apparatus using such ink jet print head.

2. Description of the Related Art

An ink jet print head has been known in which a silicon substrate is placed on an aluminum support member bonded with a printed circuit board and is electrically connected through wire bonding to the printed circuit board and in which a connecting portion for a printer body is disposed on the same side of the silicon substrate where electrothermal transducers are arranged, or on the back side of the silicon substrate.

In more concrete terms, because the printed circuit board cannot be bent, the connecting portion for the printer can only be provided on the same side of the silicon substrate where the electrothermal transducers are arranged or on a side opposite to where the electrothermal transducers are arranged.

In another ink jet print head, such as disclosed in U.S. Pat. No. 4,635,073 or 4,827,294, the silicon substrate with electrothermal transducers for ejecting ink is enclosed by a wiring member on a tape-like insulating film (hereinafter referred to as a TAB film).

Normally, in the case of semiconductor devices using the TAB film or of an ink jet print head, the four sides of a chip is surrounded by the TAB film.

In a further print head, such as disclosed in Japanese Patent Application Publication No. 5-169662 (1993), a flexible printed circuit substrate (FPC) attached with a glass epoxy substrate on the back is used, and the silicon substrate and the bonding portion of the flexible printed circuit substrate are bonded on a support member of an aluminum (Al) plate and are electrically connected together by wire-bonding. The flexible printed circuit substrate is bent so that the surface for electrical connection to the printer can be disposed on the back side of the support member with respect to the side where the electrothermal transducers are provided.

In this conventional construction, however, when a flexible substrate is used to provide an electrical connection surface for the printer body which is at an angle to the side of the silicon substrate where the electrothermal transducers are provided, the wire bonding requires fixedly holding the silicon substrate and the flexible printed circuit substrate opposed to each other on the same member. Hence, a holding member must be used. Further, it is also necessary in a last step to secure to the holding member the flexible printed circuit substrate's electrical connection surface for the printer body. This step must be carried out separately from the step of securing the silicon substrate and the flexible printed circuit substrate opposite the silicon substrate. This will increase the cost. When, for example, two heads are arranged parallelly, with one head used for ejecting a black ink and the other for ejecting color inks, the above steps need to be performed for each of the two heads, increasing the cost. Further, in the ink jet print head using the above-described TAB film, the construction in which the silicon substrate is enclosed by the TAB film on four sides becomes a hindrance when the ink is ejected by using the electrothermal transducers.

To solve these problems the inventors of this invention proposed an ink jet print head in which three of the four sides of a rectangular silicon substrate incorporating electrothermal transducers and a drive circuit for driving the electrothermal transducers are surrounded by the TAB film; in which the electrothermal transducers are arranged along the side that does not face the TAB film so that a plurality of silicon substrates can be joined to the top plate formed integral with the nozzles; and in which the connecting portion for the printer body can be arranged at an angle to the ink ejection direction.

Further, in another proposed ink jet print head, two chips of silicon substrate using the above proposal are joined to the integrally formed top plate, with one chip filled with ink and the other with a preprocessing liquid.

In the ink jet print head in which the two chips of silicon substrate proposed by the inventors are joined to the integrally formed top plate, with one chip using the ink and the other using the preprocessing liquid, because the number of electrodes formed in one chip is as small as 30, metal bulges formed on the electrodes of the silicon substrate (hereinafter referred to bumps) use stud bumps that are formed mechanically. In the case of the stud bumps, gold (Au) bumps 210 are provided on the aluminum electrodes 240 on the silicon substrate 100; the silicon substrate 100 is covered with a protective film 255 of silicon nitride (SiN) to cover the remaining part of the aluminum electrodes 240; and the leads 130 are connected at their free end to the bumps 210 of gold (Au), as shown in FIG. 2. In this construction, however, not all area of the aluminum electrodes 240 on the silicon substrate 100 cannot be covered completely with the gold (Au) metal or protective film 255, with the underlying aluminum electrodes 240 partially exposed.

In this case, because the ink is alkaline and must be neutralized, the preprocessing liquid is known to be acid. When the electrode areas on the silicon substrate are applied with an electric field by chlorine ions ($Cl^-$) present in the preprocessing liquid, it has been found that the aluminum electrodes exposed at the periphery of the metal bulges (hereinafter referred to as stud bumps) mechanically formed on the electrodes on the silicon substrate are corroded.

To prevent corrosion due to the preprocessing liquid, the following electrode construction is proposed. That is, the construction that prevents corrosion of electrodes even in the presence of the preprocessing liquid has a layer of titanium-tungsten (TiW) deposited by sputtering, which is normally used as a barrier metal, and also bumps formed of gold (Au) by plating in order to prevent corrosion of aluminum (Al) electrodes that are used for electric connection with external circuits. Because the titanium-tungsten (TiW) is not corroded by the acidic preprocessing liquid or chlorine ions ($Cl^-$) present in the preprocessing liquid, the titanium-tungsten (TiW) is made to overlap the silicon nitride (SiN), a protective film surrounding the electrodes, to completely cover the aluminum (Al) electrodes, thereby preventing the preprocessing liquid from corroding the electric wiring. Further, putting drawn-out wires of tantalum (Ta) under the titanium-tungsten (TiW) layer can obviate the need for contact holes in the protective film, which have conventionally been formed in the protective film before depositing tantalum (Ta) and processing it by patterning to draw out the uppermost tantalum (Ta) wires outside the chip. This in turn can reduce the number of processes by one and provide the silicon substrate less expensively and therefore an ink jet print head at lower cost.

A method has been proposed for detecting the presence or absence of ink by checking a capacitance component between the tantalum (Ta), a cavitation resistant film, as one electrode and another electrode arranged outside the print head. In an ink jet print head having a plurality of liquid chambers on one and the same silicon substrate, for example, the tantalum (Ta) electrode is divided into the same number of pieces as the liquid chambers, which are then drawn out of the silicon substrate to make it possible to detect when the ink in the common liquid chamber has run out.

The aluminum (Al) electrodes on the silicon substrate for the preprocessing liquid are formed in a corrosion-resistant structure in order to make the silicon substrate chip incorporating the electrothermal transducers for ejecting the preprocessing liquid equal in size to the chip for the ink. This allows the two chips for the preprocessing liquid and for the ink to share the same production facility, thus improving the design efficiency of the production facility and the utilization of the production line.

In the method which detects when the ink runs out based on the capacitance component between the tantalum (Ta), a cavitation resistant film, and another electrode arranged outside the print head, reference number 250 in FIG. 3 represents a contact hole for connecting the aluminum (Al) wire and the tantalum (Ta), and 270 indicates a step coverage portion of the contact hole 250. As shown in the figure, when the electrode of the cavitation resistant tantalum (Ta) film 230 is divided into wires, one for each liquid chamber, which are then drawn out of the silicon substrate 100, the electrode wires of the cavitation resistant tantalum (Ta) film 230 deposited over the silicon nitride (SiN) protective film 255 must be connected to the aluminum (Al) electrode 240 deposited under the protective film 255 through the contact hole 250 formed in the protective film 255 in order to secure the reliability of connection with the outside of the silicon substrate100.

The cavitation resistant tantalum (Ta) film 230, however, is thin, about 0.3 $\mu$m, so that the tantalum film over the step coverage portion 270 of the contact hole 250 formed in the protective film 255 may not be able to cover the wire of the aluminum (Al) electrode 240 and may develop cracks. Further, when the preprocessing liquid enters the cracked portion, the wire of the aluminum (Al) electrode 240 under the cavitation resistant tantalum (Ta) film 230 in the contact hole 250 is corroded.

OBJECT OF THE INVENTION

To solve these conventional problems, an object of the present invention is to provide an ink jet print head that has a layer structure of electrical connection electrodes in which a wire drawn out from the cavitation resistant film and a metal layer not corroded by ink overlap each other under a part of a metal bump, and an ink jet printing apparatus using such ink jet print head.

SUMMARY OF THE INVENTION

In the first aspect of the present invention, there is provided an ink jet print head comprising:

a silicon substrate having a plurality of electrothermal transducers for generating an ink ejection energy and a drive circuit for driving the electrothermal transducers; and a top plate joined to the silicon substrate and having nozzles or ink passages and a common liquid chamber for supplying an ink to the nozzles;

wherein the silicon substrate has three of its four sides oppose a flexible insulating film mounting a metal wiring member;

wherein metal conductor leads extend from the insulating film to the silicon substrate and are joined to electrodes on the silicon substrate;

wherein at electric joints between the metal conductor leads on the flexible insulating film and the silicon substrate are provided metal bumps comprising a metal film not corroded by the ink and a plated layer formed over the metal;

wherein the electrodes for electric connection have a layer construction such that, under a part of each of the metal bumps, a wire drawn out from a cavitation resistant film and the metal film not corroded by the ink overlap each other.

Here, two types of silicon substrates may be used jointly, one of the silicon substrates has bumps, each comprising a titanium-tungsten (TiW), which is a corrosion resistant metal, and a gold (Au) plated layer over the titanium-tungsten, and the other silicon substrate has mechanically formed bumps.

The metal bumps on the electrodes on the silicon substrate may be formed by depositing titanium-tungsten (TiW), a high-melting point metal, over aluminum electrodes and then plating gold (Au) over the high-melting point metal.

The ink jet print head may be a print head for ink that uses an ink and a preprocessing liquid and the silicon substrate with the plated metal bumps may be used on the preprocessing liquid side.

The silicon substrate with the mechanically formed metal bumps may be used on the ink side.

The ink jet print head may use thermal energy to generate a bubble in the ink and may eject the ink by the bubble as it grows.

In the second aspect of the present invention, there is provided an ink jet printing apparatus using an ink jet print head comprising:

a silicon substrate having a plurality of electrothermal transducers for generating an ink ejection energy and a drive circuit for driving the electrothermal transducers; and a top plate joined to the silicon substrate and having nozzles or ink passages and a common liquid chamber for supplying an ink to the nozzles;

wherein the silicon substrate has three of its four sides oppose a flexible insulating film mounting a metal wiring member;

wherein metal conductor leads extend from the insulating film to the silicon substrate and are joined to electrodes on the silicon substrate;

wherein at electric joints between the metal conductor leads on the flexible insulating film and the silicon substrate are provided metal bumps comprising a metal film not corroded by the ink and a plated layer formed over the metal;

wherein the electrodes for electric connection have a layer construction such that, under a part of each of the metal bumps, a wire drawn out from a cavitation resistant film and the metal film not corroded by the ink overlap each other.

DETAILED DESCRIPTION OF THE PREFERRED EMBODIMENTS

According to the present invention, the electrode structure for drawing out a cavitation resistant layer of tantalum (Ta) from the silicon substrate is formed by depositing a part of tantalum (Ta) wire over a protective film, a titanium-tungsten (TiW), which is an anti-corrosion and barrier metal, and a gold (Au) bump in that order so that the wire drawn out from the cavitation resistant layer and the metal layer not corroded by ink overlap each other. This construction can eliminate a contact hole used for connecting the tantalum (Ta) and an aluminum (Al) wire under the protective film, and therefore eliminate an area of the tantalum (Ta) that may fail to cover the aluminum (Al) wire at a step coverage portion. Hence, the aluminum wire can be protected against being corroded by a preprocessing liquid entering the cracked step coverage portion. Further, because there is no need to form a contact hole in the protective film, one mask and one process of exposure, development and etching can be eliminated, making it possible to reduce the cost of an ink ejecting silicon substrate and therefore of an ink jet print head.

Other objects, features and advantages of the present invention will become apparent from the following detailed description taken in conjunction with the accompanying drawings.

(Embodiment)

Figure 1:
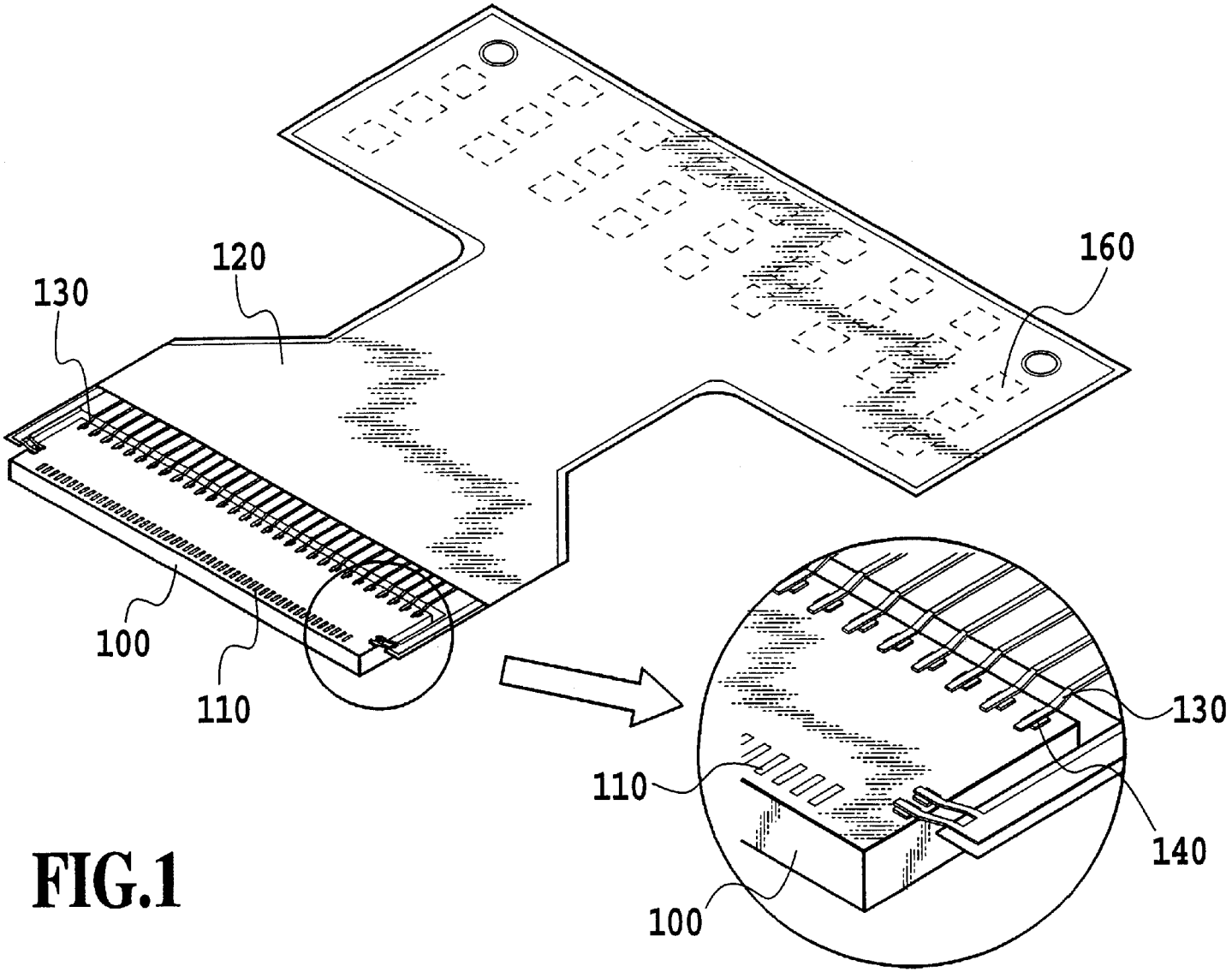
FIG. 1 is a perspective view showing a silicon substrate connected with a TAB film according to the present invention.
Figure 4:
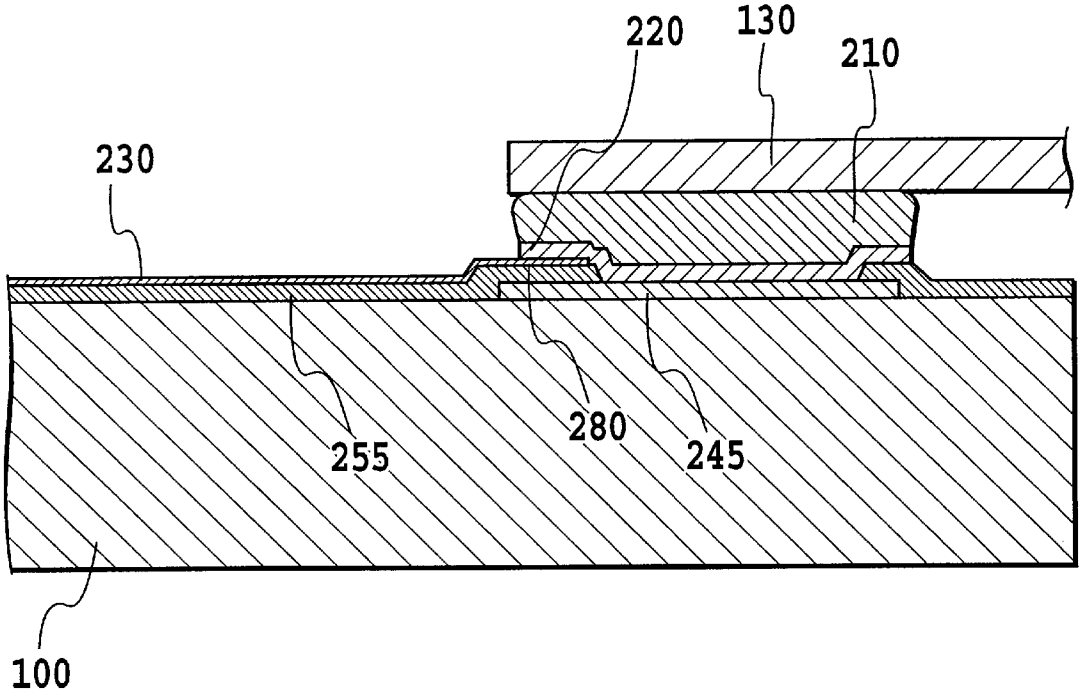
FIG. 4 is an enlarged cross section of a connecting portion between the TAB film lead and the silicon substrate, in which a titanium-tungsten layer and a cavitation resistant layer are formed overlapping each other under the plated bump.
Figure 5:
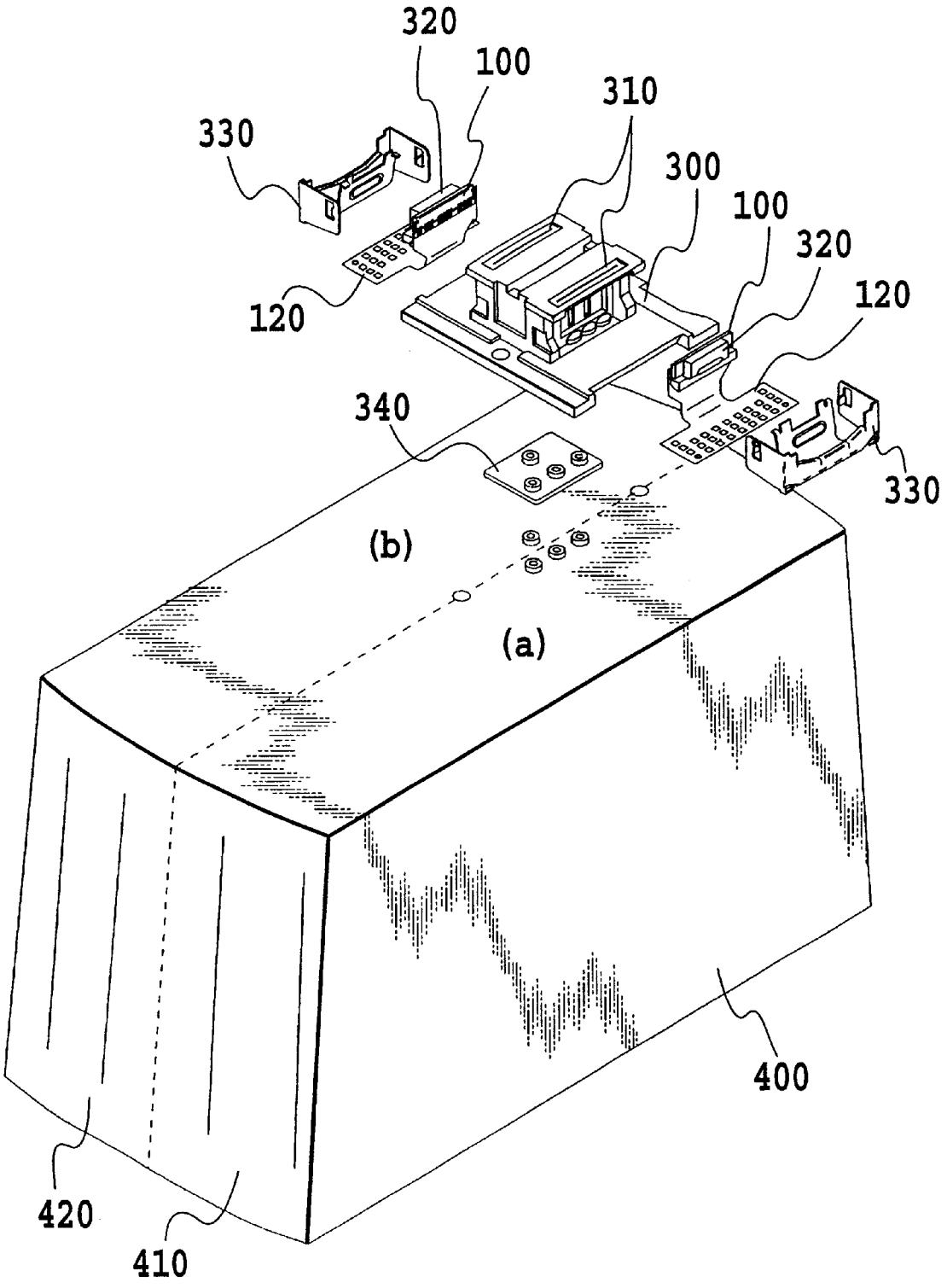
FIG. 5 is a perspective view of an ink tank for the ink jet print head using two chips of silicon substrate.

FIG. 1 shows a silicon substrate connected with a TAB film in the ink jet print head as one embodiment of the present invention. FIG. 4 is a cross section of a connecting portion of FIG. 1 according to the present invention, in which a titanium-tungsten (TiW) film, a bump formed over the TiW film by plating and a lead of the TAB film are joined, with the TiW film overlapping a cavitation resistant tantalum (Ta) film. FIG. 5 shows a construction of an ink jet print head using a two-chip silicon substrate.

As shown in FIG. 1, the ink jet print head of the present invention has a silicon substrate 100 incorporating a drive circuit for electrothermal transducers 110; electrothermal transducers 110 manufactured by the semiconductor process; a TAB film 120 which has cut off and removed its portion facing that side of the silicon substrate 100 where the electrothermal transducers 110 are arranged in order to prevent the TAB film from interfering with the ejection of ink, and which has its TAB leads 130 joined to the silicon substrate 100 before being cut off a TAB tape for further processing; leads 130 of the TAB film 120; bumps 140 to be joined with the leads 130 of the TAB film 120; a heat dissipating block 320 (FIG. 5) for releasing excess heat from the silicon substrate 100; and electric joints 160 provided on the back of the TAB film 120 for connection with a printer.

Figure 2:
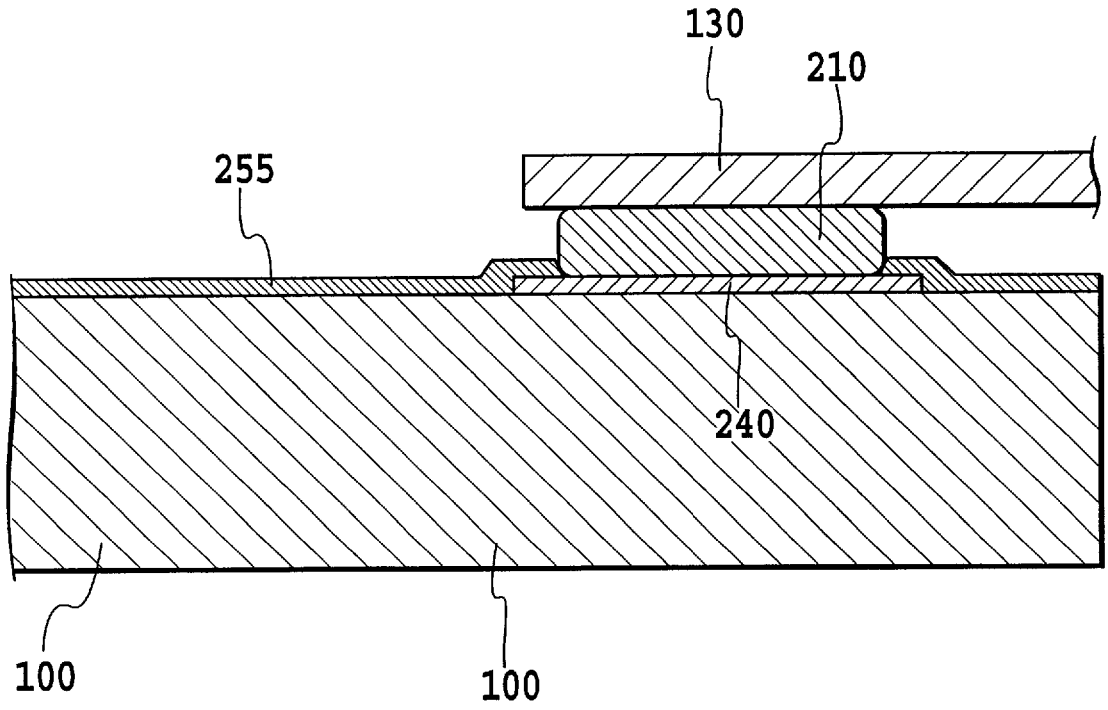
FIG. 2 is an enlarged cross section of a connecting portion formed of a stud bump between the TAB film lead and the silicon substrate.
Figure 3:
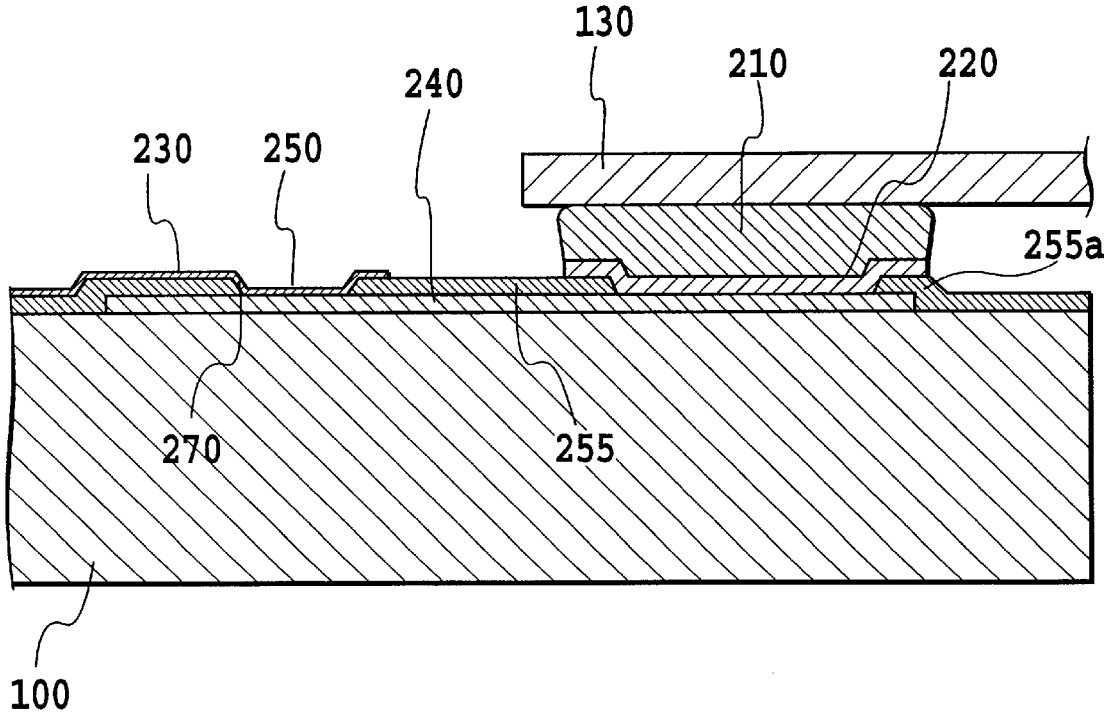
FIG. 3 is an enlarged cross section of a connecting portion between the TAB film lead and the silicon substrate, in which a tantalum wire is formed under a plated bump.

In such an ink jet print head of the present invention, among the bump structures for joining one end of the leads 130 of the TAB film 120 to the silicon substrate 100 are a stud bump structure as shown in FIG. 2 and a plated bump structure as shown in FIGS. 3 and 4.

In the plated bump structure as shown in FIG. 3, the leads 130 extending from the TAB film 120 are joined at their free ends to bumps 210 which are in turn joined to aluminum electrodes 240 on the silicon substrate 100. The aluminum electrode 240 is overlapped at its periphery with an overlap portion 255*a* of a silicon nitride (SiN) film 255, a protective film that protects the wiring area on the silicon substrate 100. This overlap portion 255*a* prevents an ingress of ink into the wiring area of the aluminum electrode 240. Further, over the silicon nitride film (SiN) 255 that protects the wiring area on the silicon substrate 100 is formed a cavitation resistant tantalum (Ta) film 230 to protect against cavitation when generating ink ejection bubbles.

In the plated bump structure as shown in FIG. 4, the leads 130 extending from the TAB film 120 are joined at their free ends to aluminum electrodes 245 on the silicon substrate 100 through bumps 210 formed of gold (Au) by plating and titanium-tungsten (TiW) films 220. In this plated bump structure, the titanium-tungsten (TiW) film 220 forms a barrier metal and a corrosion resistant structure. The titanium-tungsten (TiW) film 220 overlaps the silicon nitride (SiN) film 255 and the cavitation resistant tantalum (Ta) film 230 to form an overlap portion 280. This overlap portion 280 prevents an ingress of ink into the wiring area of the underlying aluminum electrode 245. In the electrode area, therefore, the cavitation resistant tantalum (Ta) film 230 is disposed under the titanium-tungsten (TiW) film 220 so that it can be drawn out to an external electrode.

An example of the ink jet print head using TAB film electrode leads of such a stud bump structure or plated bump structure is shown in FIG. 5. The ink jet print head has a grooved top plate 300, an orifice plate 310, and a retainer spring 330 for pressing the silicon substrate 100 against the top plate 300 from the back through a heat dissipating block 320. In this ink jet print head, a joint seal 340 seals an ink passage, with an "a" side filled with an ink and a "b" side with a preprocessing liquid.

In FIG. 5, a print head chip of the ink jet print head is made by assembling the parts of FIG. 5 and then sealing with an appropriate sealant the ink passage, a gap between the silicon substrate 100 and a common liquid chamber of the top plate 300, and electric joints 160. The print head chip, as shown, is joined through the joint seal 340 to the top of an ink tank 400, which has its interior divided into an ink accommodating portion 410 and a preprocessing liquid accommodating portion 420.

In the ink jet print head of the present invention with such a construction, the silicon substrate 100 used on the side of the preprocessing liquid has the wiring of the cavitation resistant tantalum (Ta) film 230 is laid up to the edge of openings in the protective film for the wired electrode when the silicon substrate 100 on the ink side has film layers formed thereon in a wafer state. Then, titanium-tungsten (TiW) is deposited over the wafer to a thickness of 3,000 Å by sputtering, followed by the application of a resist. Then the wafer is subjected to the photolithography process to form openings in the resist at locations corresponding to the electrode areas of the silicon substrate 100. With the underlying titanium-tungsten used as an electrode, gold (Au) is deposited by electroplating. After the resist is removed, the gold (Au) plated portions are used as a mask and the titanium-tungsten (TiW) is etched away by hydrogen peroxide. In this embodiment, the plated gold (Au) is 20 μm thick. This thickness can be reduced if the leads 130 of the TAB film do not short to the edge of the silicon substrate 100.

The titanium-tungsten (TiW) film 220 is not corroded by the preprocessing liquid and is used to have the silicon nitride (SiN) film 255, which is a protective film, overlap the aluminum electrode 240. In this embodiment, the overlapping area is 15 μm wide and because the opening for the aluminum electrode pad is 100 μm square, the bump 210 is 130 μm square. Hence, the silicon substrate 100 formed as described above is brought into contact with the top plate 300 and held tightly against the top plate 300 by the retainer spring 330, after which a silicon sealant is used to seal the ink passages, the gap between the silicon substrate 100 and the common liquid chamber of the top plate 300 and the electric joints, and then hardened. Now the ink jet print head chip is complete. The ink jet print head chip is then connected to the ink tank 400 and ink is filled into the common liquid chamber. Because the leads 130 of the TAB film 120 are covered with gold (Au) plating, they are not corroded.

With the construction described above, it was confirmed that when the weakly acid preprocessing liquid with 800 ppm of chlorine ion ($Cl^-$) filled the common liquid chamber, no corrosion occurred.

Further, because the ink does not corrode the aluminum electrode covered with a sealant, the silicon substrate 100 for ink ejection which is arranged on the "a" side of the ink jet print head shown in FIG. 5 employs the stud bump structure of FIG. 2. That is, the silicon substrate 100 on the "b" side for ejecting the preprocessing liquid uses the plated bump structure of FIG. 4 while the silicon substrate 100 for ejecting ink uses the stud bump structure of FIG. 2. This arrangement minimizes a cost increase of the silicon substrate 100.

As described above, the print head of the present invention comprises the silicon substrate 100 having a drive circuit for driving the electrothermal transducers 110, the orifice plate 310 having nozzles or ink passages, and the top plate 300 having a common liquid chamber from which to supply ink to the nozzles, all these members being jointed together. The leads 130 of metallic conductor extend from the TAB film 120 made of, for example, an insulating film opposed to the silicon substrate 100 and are joined to the electrodes on the silicon substrate 100. The metal bumps provided on the silicon substrate 100 are formed of a metal such as gold (Au) and a plated layer formed over the metal so that the electrodes are completely covered and protected. This construction prevents the bumps and electric wiring from being corroded by ink and preprocessing liquid. Further, because the silicon substrates 100 can be made equal in size in the same head, the components of the apparatus can be unified, improving the design efficiency of the production facility and the utilization of the production line.

Figure 6:
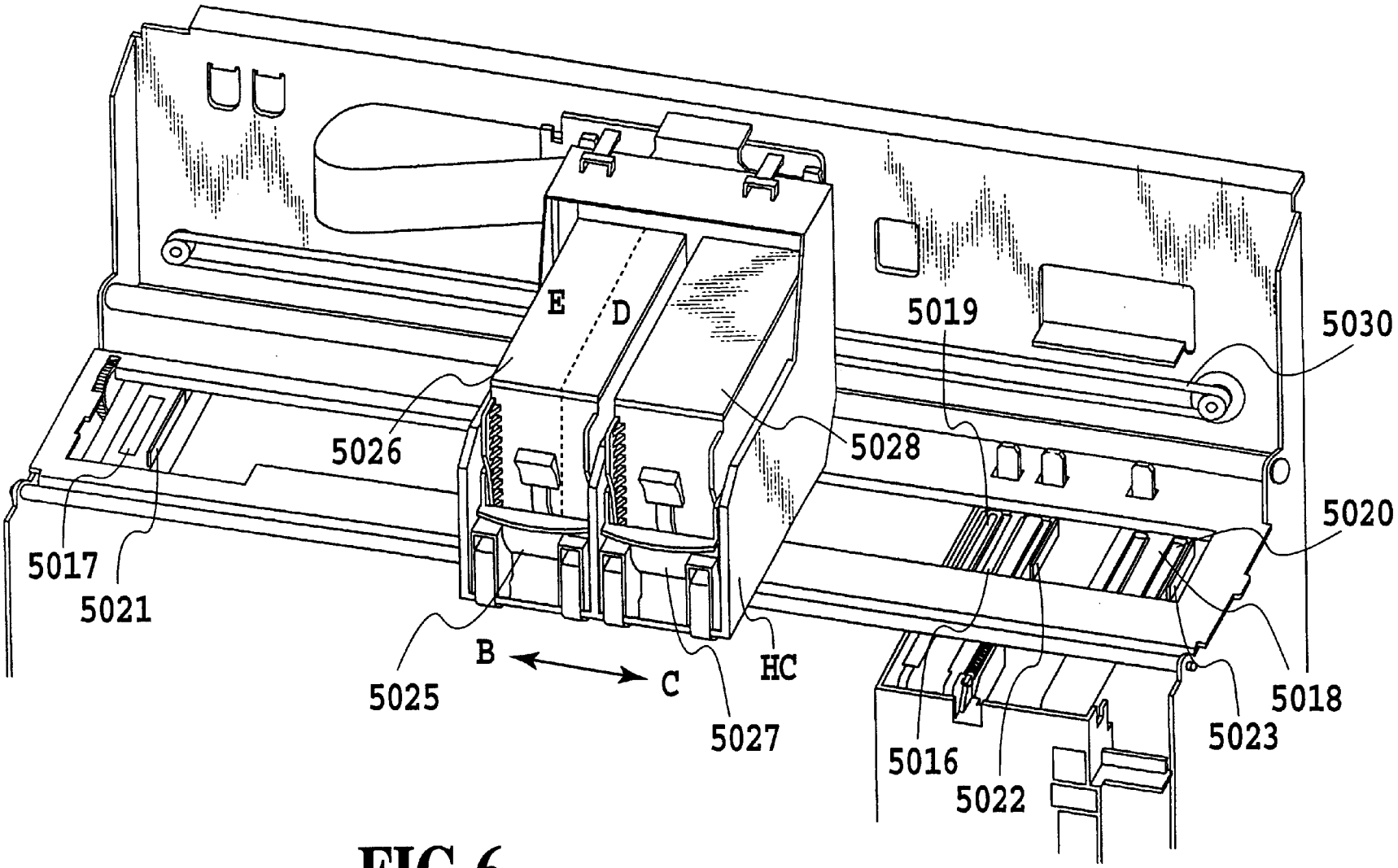
FIG. 6 is a perspective view showing an ink jet printing apparatus.

Next, the above ink jet printing apparatus as a printer will be explained. FIG. 6 shows an ink jet printing apparatus using the ink jet print head of the present invention.

As shown in the figure, a carriage HC is reciprocally moved in B and C directions as a drive motor (not shown) and a timing belt 5030 connected with the drive motor rotate in a forward or backward direction.

In the carriage HC are mounted a two-chip print head 5025 for a black (Bk) ink and a preprocessing liquid, an ink tank 5026 containing the black ink and the preprocessing liquid, a 1-chip 3-color print head 5027, and a 3-color ink tank 5028.

The black ink is filled in the black ink/preprocessing liquid tank 5026 on the D-side and the preprocessing liquid is accommodated on the E-side. According to a print signal, the preprocessing liquid and the ink are ejected in that order onto print paper. Denoted 5016 is a cap member on the black ink side of the black ink/preprocessing liquid print head 5025. Designated 5017 is a cap member on the preprocessing liquid side of the black ink/preprocessing liquid print head 5025 to cap the orifice surface of the print head. Designated 5018 is a cap member for capping the orifice surface of the color print head 5027. Reference numbers 5019 and 5020 represent suction means for drawing the ink or liquid from within the cap members 5016, 5018. The suction means 5019, 5020 each have separate suction mechanisms because the preprocessing liquid and the ink, once mixed in the cap members, solidify. The suction means 5019, 5020 can draw residual liquid or ink from the print head through an opening in each cap member 5016, 5018 for recovering the ejection performance. Denoted 5021 is a cleaning blade for the preprocessing liquid, 5022 a cleaning blade for the black ink, and 5023 a cleaning blade for the color inks. The preprocessing liquid blade is separated from the ink blades.

As described above, the inks and the preprocessing liquid are made usable on the printing apparatus and the preprocessing liquid is ejected onto the print paper prior to ejecting the inks. This arrangement can prevent the inks from spreading on the paper, thus producing an image with a clear edge or outline. Further, it is possible to enhance the water resistance of the printed image on the paper.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 54-56847 (1979) or 60-71260 (1985). The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

As described above, the ink jet print head according to claim 1 of the present invention comprises: a rectangular silicon substrate having a drive circuit for driving a plurality of electrothermal transducers, the electrothermal transducers being adapted to generate an ink ejection energy; and a top plate joined to the silicon substrate and having nozzles or ink passages and a common liquid chamber for supplying an ink to the nozzles; wherein the silicon substrate has three of its four sides oppose a flexible insulating film mounting a metal wiring member; wherein metal conductor leads extend from the flexible insulating film to the silicon substrate and are joined to electrodes on the silicon substrate; wherein the electrothermal transducers are arranged along the side of the silicon substrate that does not oppose the flexible insulating film and a plurality of such silicon substrates are used; wherein metal bumps are provided at electric joints between the metal conductor leads on the flexible insulating film and the silicon substrate; wherein the electrodes for electric connection have a layer construction such that, under a part of each of the metal bumps, a wire drawn out from a cavitation resistant film and the metal film not corroded by the ink overlap each other. This construction can protect the metal bumps and the electric wiring against being corroded by the preprocessing liquid or chlorine ions ($Cl^-$) present in the preprocessing liquid. It also allows the silicon substrates in the same print head to be made equal in size and the production facilities to be commonly shared. This in turn minimizes an increase in cost of the silicon substrate and provides an ink jet print head with high reliability at low cost. Further, by matching the size of the silicon substrate incorporating the electrothermal transducers for ejecting the preprocessing liquid to that of the silicon substrate for ejecting the ink, the production facilities can be shared and the design efficiency of the production facility and the utilization of the production line improved.

The ink jet print head according to claim 2 of the present invention which uses a plurality of silicon substrates is characterized in that two types of silicon substrates are used parallelly, one of the silicon substrates has bumps, each comprising a titanium-tungsten (TiW), which is a corrosion resistant metal, and a gold (Au) plated layer over the titanium-tungsten, and the other silicon substrate has mechanically formed bumps. Hence, the silicon substrate having the bumps formed of corrosion resistant titanium-tungsten and plated gold can protect the bumps and electric wiring against being corroded by the preprocessing liquid. It is also possible to unify the sizes of the silicon substrates, allowing the production facilities to be shared and providing an ink jet print head with high reliability.

The ink jet print head according to claim 3 of the present invention is characterized in that the metal bumps on the electrodes on the silicon substrate are formed by depositing titanium-tungsten, a high-melting point metal, over aluminum electrodes and then plating gold (Au) over the high-melting point metal. Because the titanium-tungsten (TiW) is not corroded by the acidic preprocessing liquid or chlorine ions ($Cl^-$) present in the preprocessing liquid, the aluminum electrodes and the electric wiring can be rendered uncorrodable.

The ink jet print head according to claim 4 of the present invention is characterized in that it is a print head for ink that uses an ink and a preprocessing liquid and that the silicon substrate with the plated metal bumps is used on the preprocessing liquid side. This construction can prevent the electrodes from being corroded by the preprocessing liquid and allow the sizes of the silicon substrates to be unified.

The ink jet print head according to claim 5 of the present invention is characterized in that the silicon substrate with the mechanically formed metal bumps is used on the ink side. This construction allows the sizes of the silicon substrates to be unified.

The ink jet print head according to claim 6 of the present invention is characterized in that it uses thermal energy to generate a bubble in the ink and ejects the ink by the bubble as it grows. This can suitably eject the ink to form a satisfactory image.

The ink jet printing apparatus according to claim 7 of the present invention uses the ink jet print head of any one of claim 1 to claim 6. Hence, by making the size of the silicon substrate incorporating the electrothermal transducers for ejecting the preprocessing liquid equal to that of the silicon substrate on the ink side, the production facilities can be shared and at the same time the design efficiency of the production facilities and the utilization of the production line can be improved.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet print head comprising:

a silicon substrate including a plurality of electrothermal transducers for generating an ink ejection energy and a drive circuit for driving the electrothermal transducers; and a top plate joined to the silicon substrate and including nozzles or ink passages and a common liquid chamber for supplying ink to the nozzles, wherein three of four sides of the silicon substrate oppose a flexible insulating film mounting a metal wiring member, wherein metal conductor leads extend from the flexible insulating film to the silicon substrate and are joined to electrodes on the silicon substrate, wherein at electric joints between the metal conductor leads and the silicon substrate there are provided plated metal bumps comprising a metal film not corroded by the ink and a plated layer formed over the metal film, the plated metal bumps being formed by depositing titanium-tungsten (TiW), a high-melting point metal, over aluminum electrodes and then plating gold (Au) over the titanium-tungsten (TiW), and wherein the electrodes for electric connection have a layer construction such that, under a part of each of the plated metal bumps, a wire drawn out from a cavitation resistant film and the metal film not corroded by the ink overlap each other.

2. An ink jet print head as claimed in claim 1, wherein the ink jet print head uses thermal energy to generate a bubble in the ink to eject the ink.

3. An ink jet print head using a plurality of silicon substrates, wherein two types of silicon substrates are used jointly, said ink jet print head comprising:

a plurality of silicon substrates each including a plurality of electrothermal transducers for generating an ink ejection energy and a drive circuit for driving the electrothermal transducers; and a top plate joined to the plurality of silicon substrates and including nozzles or ink passages and a common liquid chamber for supplying ink to the nozzles, wherein, for each of the silicon substrates, three of four sides of the silicon substrate oppose a flexible insulating film mounting a metal wiring member, and metal conductor leads extend from the flexible insulating film to the silicon substrate and are joined to electrodes on the silicon substrate, wherein, for a first one of the silicon substrates, at electric joints between the metal conductor leads and the second silicon substrate there are provided plated metal bumps each comprising a film of titanium-tungsten (TiW), which is a corrosion resistant metal, and a gold (Au) plated layer formed over the titanium-tungsten film, and the electrodes for electric connection have a layer construction such that, under a part of each of the plated metal bumps, the titanium-tungsten (TiW) film and a wire drawn out from a cavitation resistant film overlap each other, and wherein, for a second one of silicon substrates, at electric joints between the metal conductor leads and the first silicon substrate there are provided mechanically formed stud bumps.

4. An ink jet print head as claimed in claim 3, further comprising an ink tank for separately accommodating ink in an ink accommodating portion on one side of the ink tank and a preprocessing liquid in a preprocessing liquid accommodating portion on another side of the ink tank, wherein the ink jet print head discharges ink and a preprocessing liquid and the first silicon substrate with the plated metal bumps is arranged on the preprocessing liquid side of the ink tank.

5. An ink jet print head as claimed in claim 3, further comprising an ink tank for separately accommodating ink in an ink accommodating portion on one side of the ink tank and a preprocessing liquid in a preprocessing liquid accommodating portion on another side of the ink tank, wherein the ink jet print head discharges ink and a preprocessing liquid and the second silicon substrate with the mechanically formed stud bumps is arranged on the ink side of the ink tank.

6. An ink jet printing apparatus using an ink jet print head comprising:

a silicon substrate including a plurality of electrothermal transducers for generating an ink ejection energy and a drive circuit for driving the electrothermal transducers; and a top plate joined to the silicon substrate and including nozzles or ink passages and a common liquid chamber for supplying ink to the nozzles, wherein three of four sides of the silicon substrate oppose a flexible insulating film mounting a metal wiring member, wherein metal conductor leads extend from the flexible insulating film to the silicon substrate and are joined to electrodes on the silicon substrate, wherein at electric joints between the metal conductor leads and the silicon substrate there are provided plated metal bumps comprising a metal film not corroded by the ink and a plated layer formed over the metal film, the plated metal bumps being formed by depositing titanium-tungsten (TiW), a high-melting point metal, over aluminum electrodes and then plating gold (Au) over the titanium-tungsten (TiW), and wherein the electrodes for electric connection have a layer construction such that, under a part of each of the plated metal bumps, a wire drawn out from a cavitation resistant film and the metal film not corroded by the ink overlap each other.

7. An ink jet printing apparatus using an ink jet print head as claimed in claim 6, wherein the ink jet print head uses thermal energy to generate a bubble in the ink to eject the ink.

8. An ink jet printing apparatus using an ink jet print head wherein two types of silicon substrates are used jointly, comprising:

a plurality of silicon substrates each including a plurality of electrothermal transducers for generating an ink ejection energy and a drive circuit for driving the electrothermal transducers; and a top plate joined to the plurality of silicon substrates and including nozzles or ink passages and a common liquid chamber for supplying ink to the nozzles, wherein, for each of the silicon substrates, three of four sides of the silicon substrate oppose a flexible insulating film mounting a metal wiring member, and metal conductor leads extend from the flexible insulating film to the silicon substrate and are joined to electrodes on the silicon substrate, wherein, for a first one of the silicon substrates, at electric joints between the metal conductor leads and the second silicon substrate there are provided plated metal bumps each comprising a film of titanium-tungsten (TiW), which is a corrosion resistant metal, and a gold (Au) plated layer formed over the titanium-tungsten film, and the electrodes for electric connection have a layer construction such that, under a part of each of the plated metal bumps, the titanium-tungsten (TiW) film and a wire drawn out from a cavitation resistant film overlap each other, and wherein, for a second one of silicon substrates, at electric joints between the metal conductor leads and the first silicon substrate there are provided mechanically formed stud bumps.

9. An ink jet printing apparatus using an ink jet print head as claimed in claim 8, further comprising an ink tank for separately accommodating ink in an ink accommodating portion on one side of the ink tank and a preprocessing liquid in a preprocessing liquid accommodating portion on another side of the ink tank, wherein the ink jet print head discharges ink and a preprocessing liquid and the first silicon substrate with the plated metal bumps is arranged on the preprocessing liquid side of the ink tank.

10. An ink jet printing apparatus using an ink jet print head as claimed in claim 8, further comprising an ink tank for separately accommodating ink in an ink accommodating portion on one side of the ink tank and a preprocessing liquid in a preprocessing liquid accommodating portion on another side of the ink tank, wherein the ink jet print head discharges ink and a preprocessing liquid and the second silicon substrate with the mechanically formed stud bumps is arranged on the ink side of the ink tank.

* * * * *

UNITED STATES PATENT AND TRADEMARK OFFICE

CERTIFICATE OF CORRECTION

PATENT NO. : 6,450,617 B1
DATED : September 17, 2002
INVENTOR(S) : Masashi Kitani et al.

It is certified that error appears in the above-identified patent and that said Letters Patent is hereby corrected as shown below:

Title page,
Item [57], ABSTRACT,
Line 2, “A” should read -- In a --; and
Line 3, “head” should read -- head, --.

Column 1,
Line 39, “is” should read -- are --.

Column 2,
Line 16, “integral” should read -- integrally --;
Line 29, “to” should read -- to as --;
Line 37, “all” should read -- all of the --;
Line 38, “cannot” should read -- can --; and
Line 39, “with” should read -- leaving --.

Column 3,
Line 42, “substrate100.” should read -- substrate 100. --.

Column 4,
Lines 13 and 57, “metal;” should read -- metal; and --.

Column 6,
Line 55, “is” should be deleted; and
Line 56, “when” should read -- while --.

UNITED STATES PATENT AND TRADEMARK OFFICE

CERTIFICATE OF CORRECTION

PATENT NO. : 6,450,617 B1 
DATED : September 17, 2002
INVENTOR(S) : Masashi Kitani et al.

It is certified that error appears in the above-identified patent and that said Letters Patent is hereby corrected as shown below:

Column 9,
Line 18, “consists” should read -- consist --.

Signed and Sealed this

Twenty-ninth Day of July, 2003

JAMES E. ROGAN
*Director of the United States Patent and Trademark Office*